US005443009A

United States Patent [19]

Thiesen et al.

[11] Patent Number: 5,443,009

[45] Date of Patent: Aug. 22, 1995

[54] CHARGE ARRANGEMENT FOR CARTRIDGE AMMUNITION

[75] Inventors: Stefan Thiesen, Willich; Eckhard Rahnenführer, Dormagen; Josef Köhler, Ampfing, all of Germany

[73] Assignees: Rheinmetall GmbH, Ratingen; WNC Nitrochemie GmbH, Aschau/Inn both of Germany

[21] Appl. No.: 254,105

[22] Filed: Jun. 6, 1994

[30] Foreign Application Priority Data

Jun. 5, 1993 [DE] Germany ..... 43 18 740.4

[51] Int. Cl.[6] ..... F42B 5/02

[52] U.S. Cl. ..... 102/443; 102/430; 102/439; 102/470

[58] Field of Search ..... 102/202, 430, 431, 433, 102/434, 439, 441, 443, 469, 470, 472, 700

[56] References Cited

U.S. PATENT DOCUMENTS

| | | | |
|---|---|---|---|
| 3,491,690 | 1/1970 | Knight . | |
| 3,901,153 | 8/1975 | Brabets et al. . | |
| 4,572,078 | 2/1986 | Bell | 102/431 |
| 4,671,179 | 6/1987 | Synofzik et al. | 102/430 |
| 4,763,577 | 8/1988 | Romer et al. | 102/431 |
| 5,048,422 | 9/1991 | Northrup et al. | 102/434 |
| 5,052,304 | 10/1991 | Rahnenführer et al. . | |
| 5,183,961 | 2/1993 | Campoli et al. . | |
| 5,237,927 | 8/1993 | Gonzalez et al. | 102/431 |

FOREIGN PATENT DOCUMENTS

| | | | |
|---|---|---|---|
| 0344098A | 11/1989 | European Pat. Off. . | |
| 499906 | 8/1992 | European Pat. Off. | 102/430 |
| 0526835 | 2/1993 | European Pat. Off. . | |
| 713671 | 10/1931 | France . | |
| 3442741 | 5/1986 | Germany . | |
| 3924986 | 1/1991 | Germany . | |
| 4223735 | 1/1994 | Germany | 102/470 |
| 404198695 | 7/1992 | Japan | 102/439 |
| WO91/05981 | 5/1991 | WIPO . | |

*Primary Examiner*—Harold J. Tudor
*Attorney, Agent, or Firm*—Spencer, Frank & Schneider

[57] ABSTRACT

A charge arrangement for cartridge ammunition having a cartridge case, a bottom igniter secured in the case bottom and a primer that coaxially surrounds at least one part of the propellant composed of bulk powder and a tail-side part of a projectile that projects into the cartridge case. To ensure reliable ignition of the propellant bulk in a simple manner, a primer is provided that is comprised of either a separate, relatively thin-walled, combustible sleeve or the inner layer of a multilayer, combustible cartridge case which faces the propellant.

5 Claims, 2 Drawing Sheets

CHARGE ARRANGEMENT FOR CARTRIDGE AMMUNITION

BACKGROUND OF THE INVENTION

The invention relates to a charge arrangement for cartridge ammunition having a cartridge case, a bottom igniter secured in the case bottom and a primer that coaxially surrounds at least one part of the propellant compound composed of bulk powder and a tail-side part of a projectile that projects into the cartridge case.

This type of charge arrangement is disclosed, for example, in German Patent No. 3,442, 741.A1. Such an arrangement comprises a cartridge case filled with bulk powder and a propelling charge igniter, that is a bottom igniter secured in the bottom of the case. To achieve the most uniform and fastest burn-through of the bulk powder, a tubular propellant is used for ignition transfer that rests directly against the inside wall of the cartridge case and thus coaxially surrounds the propellant (TLP).

A significant drawback in this type of charge arrangement is that attachment of the ignition charges to the sleeve wall is relatively costly. Moreover, the ignition charges reduce the charge space available for the actual propulsion, leading to a corresponding power loss. Furthermore, this type of charge design is sensitive with respect to "rough handling" of the cartridge.

Another charge arrangement is disclosed in German Patent No. 3,924,986.A1, in which ignition is effected with the aid of a central igniter. However, to meet current terminal ballistic requirements, modern projectiles must have the longest possible kinetic energy penetrator. The result of this is that the projectile tail (with guiding mechanism) projects so far into the cartridge case that no space remains for a central igniter.

SUMMARY OF THE INVENTION

It is therefore an object of the invention to provide a novel charge arrangement in which reliable ignition transfer takes place in a simple manner without the use of a primer tube that is disposed centrally in the cartridge case and that limits the ballistic power of the projectiles, or ignition charges disposed at the edges.

The above and other objects are accomplished in accordance with the invention by the provision of a charge arrangement for cartridge ammunition, including: a cartridge case having an inside wall, a case bottom and a case top; a projectile having a tail-side extending into the cartridge case through the case top; a bottom igniter secured in the case bottom; bulk powder propellant compound disposed in the cartridge case and surrounding the tail-side part of the projectile, the propellant compound having a predetermined axial flame propagation speed; and a primer coaxially surrounding at least one part of the propellant compound and the tail-side part of the projectile, the primer comprising a sleeve composed of combustible material having an activity selected so the sleeve has a burning speed greater than the axial flame propagation speed of the propellant compound, and the sleeve having a longitudinal extension which is a preset distance from the inside wall of the cartridge case so that the primer can act upon the propellant located both inside the sleeve and between the cartridge case and the sleeve.

The invention is essentially based on the concept of using a relatively thin-walled, combustible sleeve in ignition transfer, the diameter of which is selected such that the sleeve surrounds the tail-side part of the projectile, but does not touch the cartridge case, so that it acts on the propellant on both sides of the sleeve during ignition. The material density, dynamic activity and consequently the burning speed of the sleeve material are selected high enough that the sleeve acts as a primer, thereby effecting uniform ignition over the entire length of the propellant bulk.

According to another embodiment of the invention, a charge arrangement is provided for cartridge ammunition, including: a cartridge case having a case bottom and a case top; a projectile having a tail-side extending into the cartridge case through the case top; a bottom igniter secured in the case bottom; and bulk powder propellant compound disposed in the cartridge case and surrounding the tail-side part of the projectile, the propellent compound having a predetermined axial flame propagation speed; wherein the cartridge case is a multilayer combustible cartridge case having an outer combustible layer with a predetermined activity and an inner primer layer facing the propellant compound, having an activity that is greater than the predetermined activity of the outer layer and a burning speed that is greater than the predetermined axial flame propagation speed of the propellant compound.

In this embodiment, which is particularly simple to manufacture, the layer inner of a multilayer, combustible cartridge case which faces the propellant is configured as a transfer igniter. This inside layer thus has an activity that is significantly greater than that of the outer layers of the cartridge case that protect the interior of the charge. The burning speed of the inside sleeve layer is also to be selected high enough that this layer acts as a primer.

Further details and advantages of the invention ensue from the following embodiments described by way of the drawing figures.

DETAILED DESCRIPTION OF THE PREFERRED EMBODIMENTS

Figure 1:
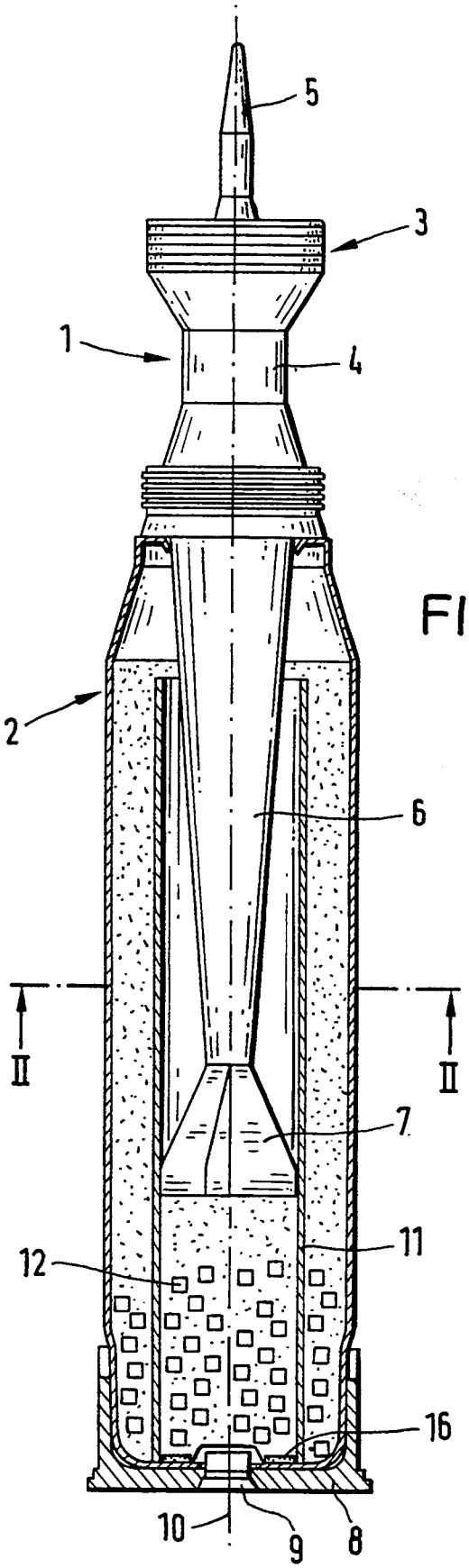
FIG. 1 is a partial, longitudinal section of a first embodiment of a cartridge comprising a cartridge case and a projectile and, as a primer, a cylindrical inner sleeve disposed inside the cartridge case.

Referring to FIG. 1, there is shown a cartridge 1 that essentially comprises a cartridge case 2 and a subcaliber projectile 3. In a known way, projectile 3 has a propelling cage 4, in front of which a projectile tip 5 is located. A tail-side projectile 6, with a guide mechanism 7, is located behind propelling cage 4 and projects into cartridge case 2.

At its end remote from projectile 3, cartridge case 2 is secured to a metallic case bottom 8 in which a bottom igniter 9 is disposed. In accordance with the invention, a cylindrical sleeve 11 in the form of a single, continuous tube having a preset activity and acting as the primer is disposed coaxially around longitudinal axis 10 of cartridge 1 such that a bulk powder propellant compound 12 is located both inside sleeve 11 and between sleeve 11 and cartridge case 2. As can be seen in FIG. 1, sleeve 11 extends in a longitudinal direction to a position adjacent bottom igniter 9.

To support ignition transfer from bottom igniter 9 to primer sleeve 11, an additional charge 16, preferably an annular bag 16 of black powder, can be installed, resulting in rapid ignition of propellant compound 12.

Cylindrical sleeve 11 can be produced in two ways: the first is with the aid of a so-called matting process, in which a fibrous web is separated out in an aqueous pulp through immersion and suction via a shaping mandrel and subsequently compressed on a heated press. Sleeve 11 can also be produced by a wrapping method, in which a paper web that contains the corresponding components (primarily nitrocellulose) is continuously wrapped around a cylindrical arbor and subsequently cut to the desired length. In both methods, the activity can be set over a relatively wide range by corresponding selection of the material density of sleeve 11. The activity of sleeve 11 should be selected so that the burning speed of the sleeve is greater than the axial flame propagation speed in the propellant compound 12. The density should be between approximately 0.4 and 1.2 g/cm$^3$. The wall thickness of sleeve 11 is to be selected as thin as possible so that it takes up correspondingly little space. It has been seen in practice that the wall thickness of sleeve 11 should preferably be between about 0.5 and about 3.5 mm, and more preferably between about 1.0 and about 2.0 mm.

Sleeve 11 has a diameter that corresponds to the widest diameter of projectile tail 6 at the projectile-side end and is centered by the tail.

Figure 2:
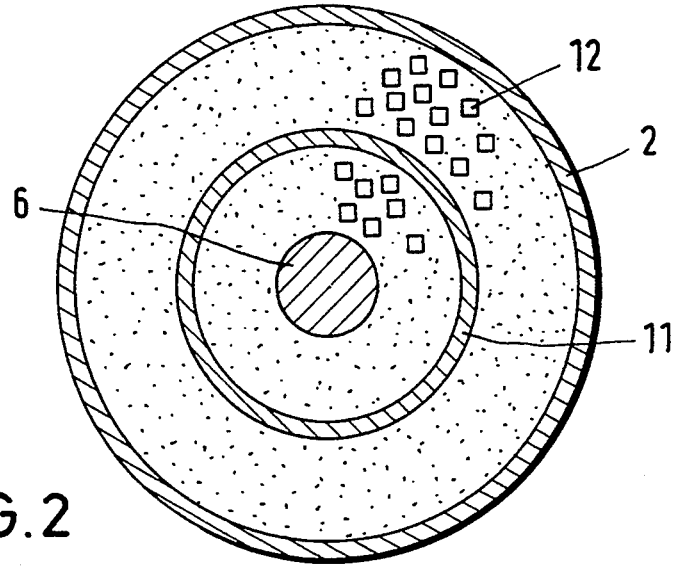
FIG. 2 is a cross-section along line II—II of the cartridge shown in FIG. 1.

FIG. 2 shows an enlarged cross-section along line II—II in FIG. 1. The reference numerals correspond to those in FIG. 1.

Figure 3:
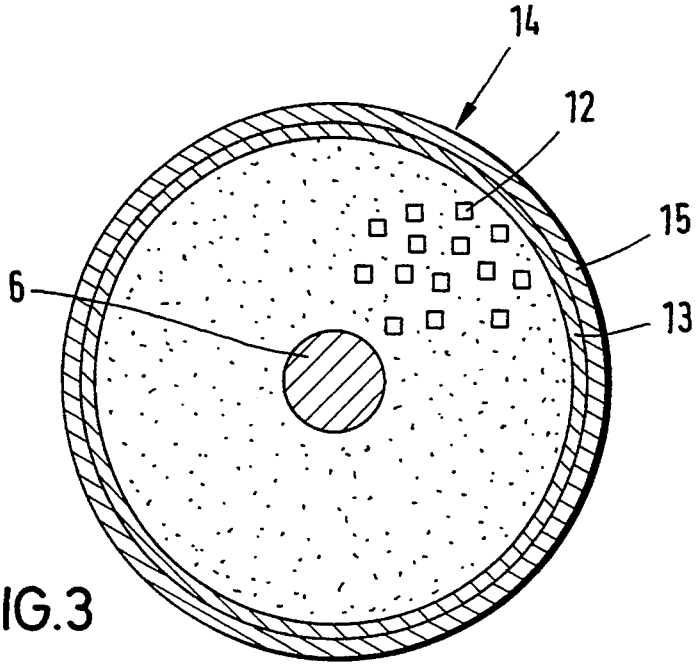
FIG. 3 is a cross-section corresponding to that of FIG. 2 of a second embodiment of a cartridge case that comprises two layers.

FIG. 3 shows a cross-section of a second embodiment in the same region of a cartridge case as the cross section in FIG. 2. In FIG. 3, the primer sleeve is in the form of an inner layer 13 of a multilayer cartridge case 14 having an outer layer 15.

This type of sleeve design has the advantage that it is simple to produce, and ensures good (edge-side) ignition of the propellant with appropriate selection of the activity of inner layer 13. The activity of outer layer 15 adjoining inner layer 13 should have a value that ensures sufficient protection of the charge interior. The activity can also be set according to the material density. The activity of inner layer 13 should be set so that it is greater than the activity of outer layer 15 and so that inner layer 13 has a burning speed greater than the axial flame propagation speed of propellant compound 12. In a preferred embodiment in which the cartridge case is made of a felt composed of 62% nitrocellulose, 1% stabilizer and 37% kraft pulp, the inner layer 13 has a density of 0.5 g/cm$^3$, while the outer layer has a density of 0.9 cm/$^3$.

When selecting the layer thicknesses, it must be taken into consideration that, with a preset caliber, the wall of the cartridge case should be as thin as possible to allow a quantity of propellant as large as possible to be put into the cartridge case, and the wall of the cartridge case must also be sufficiently stable. In a two-layer cartridge case 14 having a wall thickness of approximately 3.3 mm (for 120 mm cartridges), the preferred layer thickness values for the inner layer 13 are between about 0.1 and about 2 mm, preferably between about 0.8 and about 1.7 mm.

The invention has been described in detail with respect to preferred embodiments, and it will now be apparent from the foregoing to those skilled in the art that changes and modifications may be made without departing from the invention and its boarder aspects, and the invention, therefore, in the appended claims to cover all such changes and modifications as fall within the true spirit of the invention.

What is claimed is:

1. A charge arrangement for cartridge ammunition, comprising:

a cartridge case having an inside wall, a case bottom and a case top;

a projectile having a tail-side extending into said cartridge case through said case top;

a bottom igniter secured in the case bottom;

bulk powder propellant compound disposed in said cartridge case and surrounding the tail-side part of the projectile, said propellent compound having a predetermined axial flame propagation speed; and a primer coaxially surrounding at least one part of the propellant compound and the tail-side of said projectile, said primer comprising a single, continuous, tubular sleeve composed of combustible material having an activity selected so that said sleeve has a burning speed greater than the axial flame propagation speed of the propellant compound, said sleeve having a longitudinal extent which is a preset distance from the inside wall of said cartridge case so that the primer can act upon the propellant compound located both inside said sleeve and between said cartridge case and said sleeve, and said sleeve extending to a position adjacent said igniter.

2. A charge arrangement as defined in claim 1, wherein said sleeve has an inside diameter corresponding to the widest diameter of the tail-side of the projectile and is centered by the same.

3. A charge arrangement as defined in claim 1, wherein said sleeve has a wall thickness between about 0.5 mm and about 3.5 mm.

4. A charge arrangement as defined in claim 1, wherein said sleeve has a wall thickness between about 1.0 and about 2.0 mm.

5. A charge arrangement as defined in claim 1, wherein said sleeve comprises approximately 62% nitrocellulose, 1% stabilizer and 37% kraft pulp, and has a material density between about 0.4 g/cm$^3$ and about 1.2 g/cm$^3$.

* * * * *